United States Patent [19]

Kimura et al.

[11] 4,057,957

[45] Nov. 15, 1977

[54] ALARM DEVICE OF CLOCKS

[75] Inventors: Rokusaburo Kimura, Kobe; Sadashige Horii, Shijonawate, both of Japan

[73] Assignee: Matsushita Electric Works, Ltd., Japan

[21] Appl. No.: 675,162

[22] Filed: Apr. 8, 1976

[51] Int. Cl.[2] ..... G04C 21/16

[52] U.S. Cl. ..... 58/21.155; 58/19 R; 58/21.15; 58/38 R

[58] Field of Search ..... 58/19 B, 21.15, 21.155, 58/38

[56] References Cited

U.S. PATENT DOCUMENTS

| | | | |
|---|---|---|---|
| 3,475,899 | 11/1969 | Boyles | 58/21.155 X |
| 3,686,878 | 8/1972 | Patrick et al. | 58/21.155 |
| 3,725,617 | 4/1973 | Boyles et al. | 58/21.155 X |
| 3,875,737 | 4/1975 | Boyle | 58/21.155 |
| 3,930,360 | 1/1976 | Boyles | 58/21.155 |
| 3,952,177 | 4/1976 | Murata et al. | 58/38 R X |

*Primary Examiner*—E. S. Jackmon

*Attorney, Agent, or Firm*—Pierce, Scheffler & Parker

[57] ABSTRACT

An alarm device of clocks having snoozing function in which, when a set time is reached in clock mechanism, switching means for alarm sound source is actuated to be ON-state through an actuating lever by a set-time indexing wheel shifted on a shaft being rotated by the clock mechanism. The actuating lever disposed for transmitting the shifted motion of the indexing wheel to the switching means is pivotable respectively in a first plane including axial shifting directions of the wheel and in a second plane perpendicular to the first plane. Pivotal motion of the lever in the first plane following-the shifted motion of the wheel on the set time causes the switching means to be switched ON, in which state a snoozing means manually operated moves the lever pivotally in the second plane to cause the switching means temporarily to be switched OFF and restrict the lever in this position for a fixed cyclic period after the set time. As long as the lever is in the pivotally moved position in the first plane, repetitive restrictions of the lever in the position moved in the second plane by the snoozing mechanism are also released in the same cycle of the fixed period to repetitively sound the alarm sound source.

3 Claims, 26 Drawing Figures

Fig. 6A
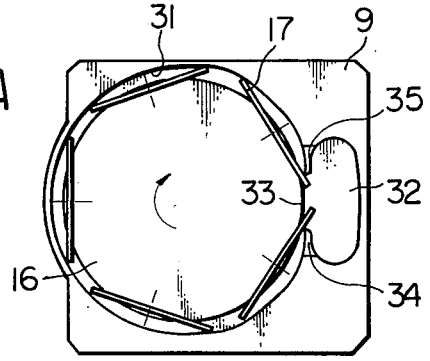
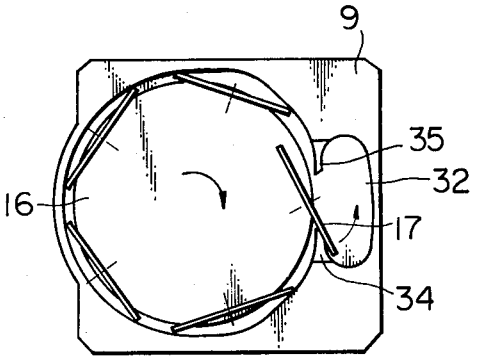
Fig. 6B
Fig. 6C
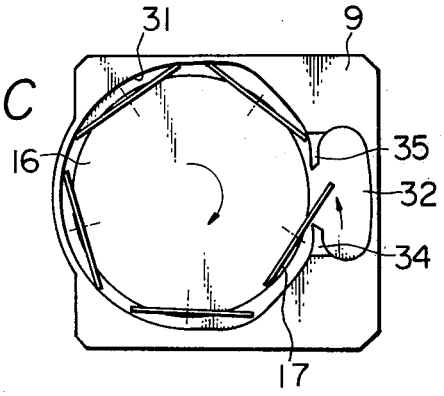

ALARM DEVICE OF CLOCKS

This invention relates to alarming device of clocks and, more particularly, to improvements in alarming device of clocks having snoozing function.

In conventional clocks of the kind referred to, time switching mechanism or, in other words, a mechanism of sounding an alarm buzzer when a set time is reached, and a snoozing mechanism or, in other words, a mechanism of temporarily returning a time switch to the original state even when a set time is reached, are formed independently of each other and, therefore, the structure of the clock has been complicated. The present invention has been suggested to remove such defects of conventional clocks.

According to the present invention, the defects have been successfully removed with provisions of an actuating lever cooperating with a set time indexing wheel for closing swtich contacts of alarm buzzer circuit when a set time is reached, which lever being adapted to temporarily open the switch contacts and to again close the contacts after a predetermined time lapsed.

A primary object of the present invention is, therefore, to provide an alarm device of clocks in which an actuating lever is made to have a snoozing function so that the structure is simple and the number of component parts is reduced.

Another object of the present invention is to provide a clock alarm device which can be manufactured at a lower cost.

The present invention shall now be explained in detail with reference to a most preferable embodiment illustrated in accompanying drawings, in which.

Figure 5B:
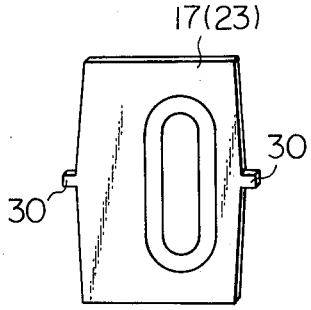
Figure 5A:
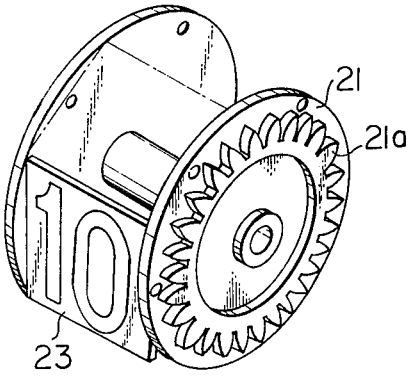
Figure 5C:
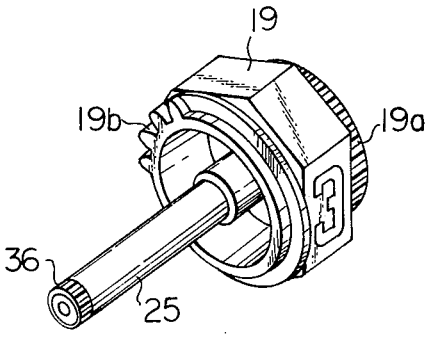
Figure 6D:
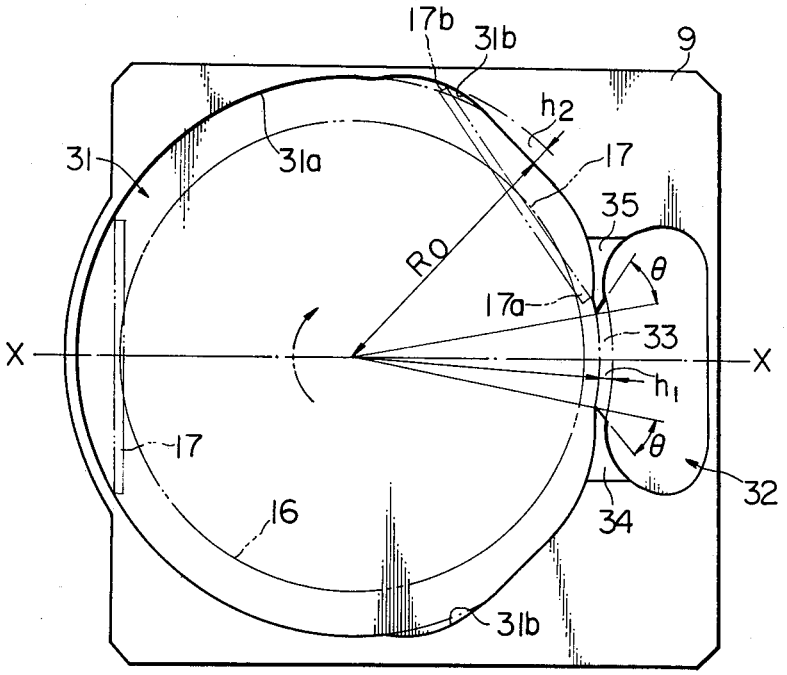
Figure 7:
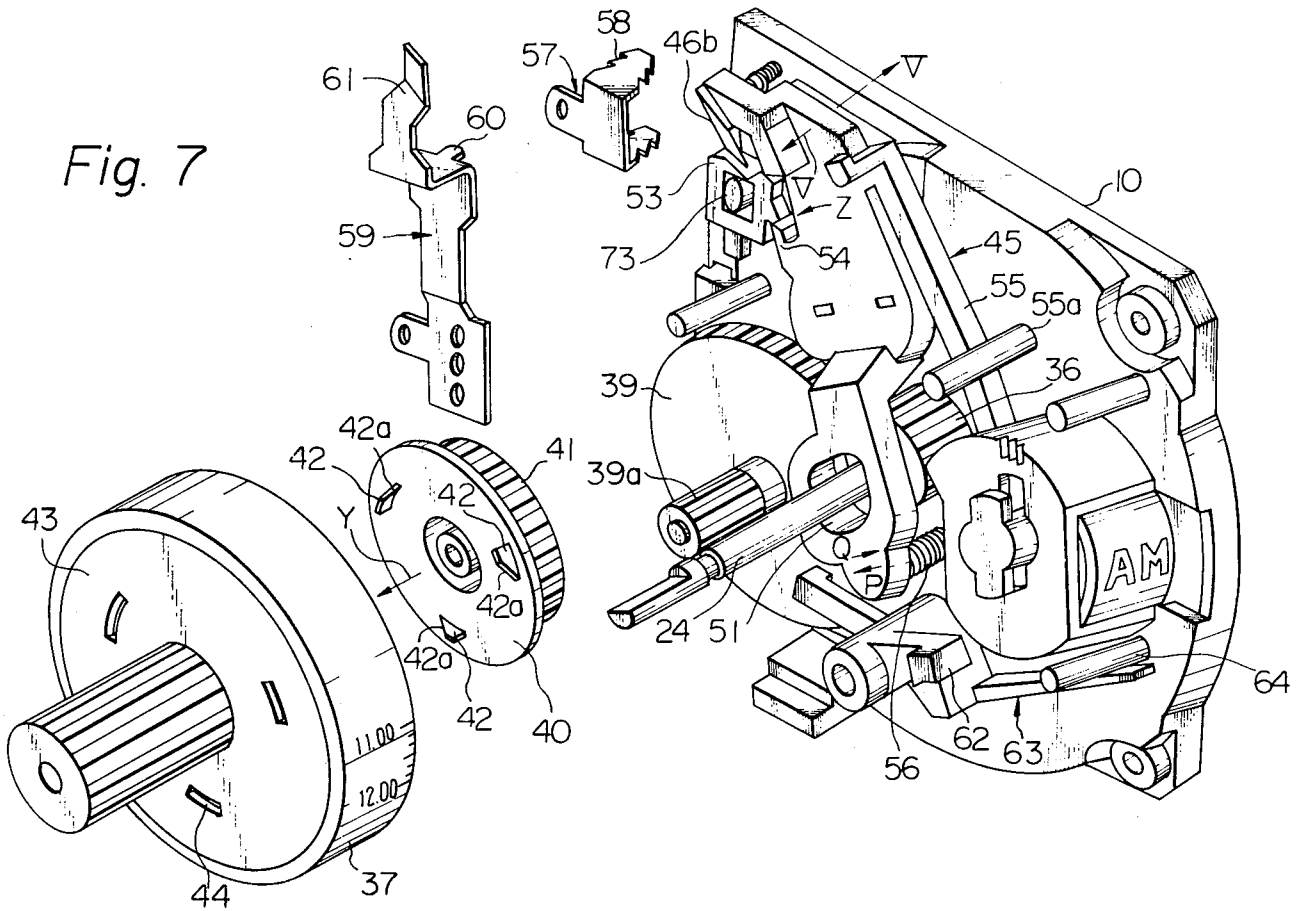
Figure 8A:
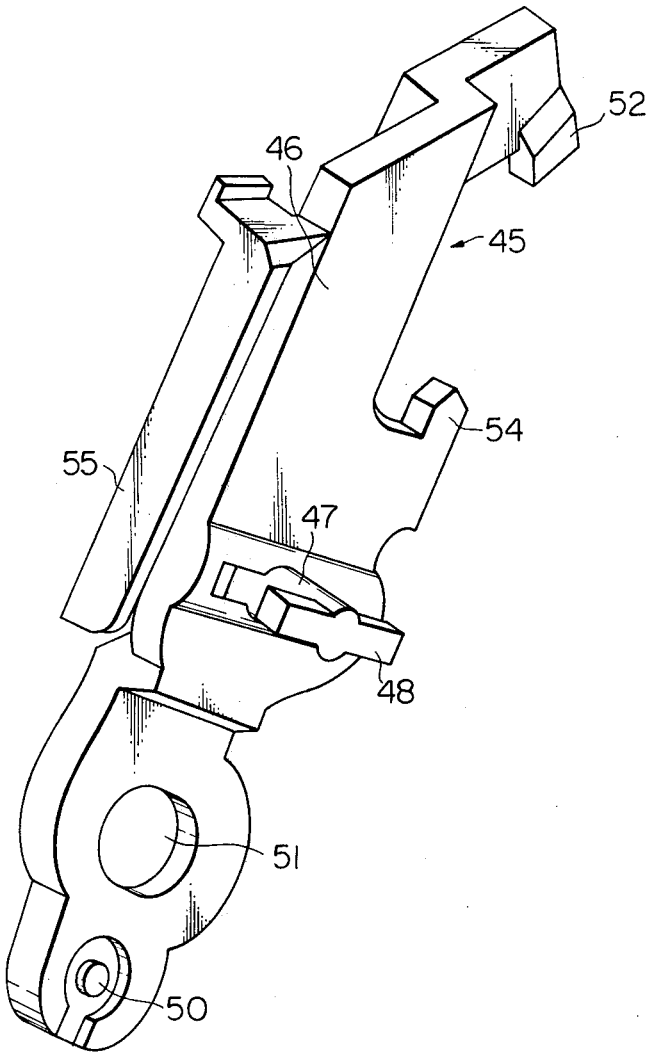
Figure 8C:
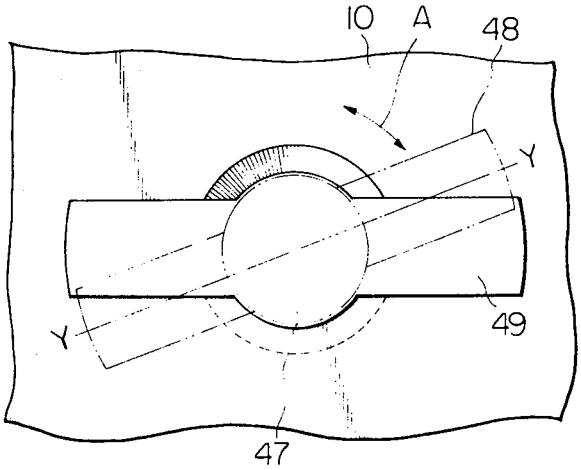
Figure 8B:
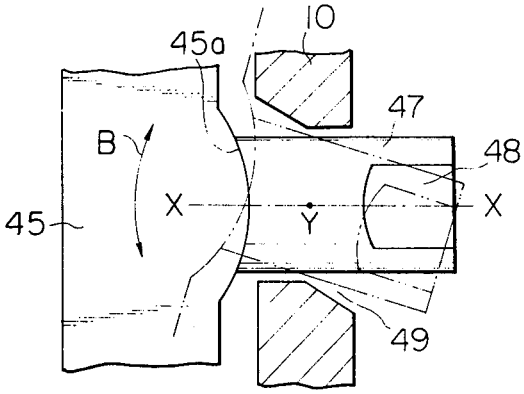
Figure 9A:
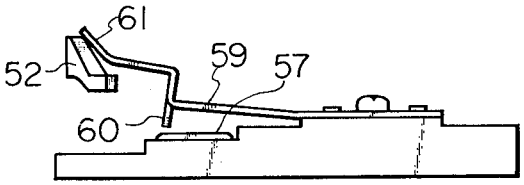
Figure 9B:
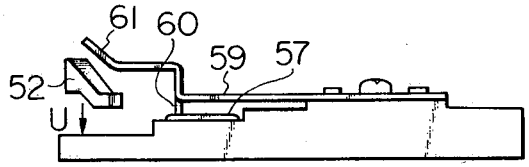
Figure 10A:
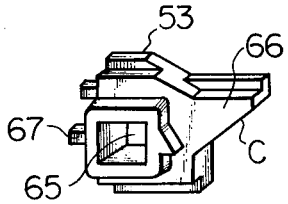
Figure 10B:
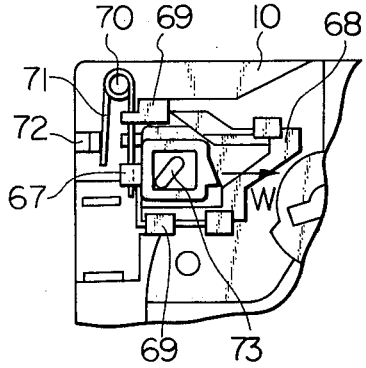
Figure 11A:
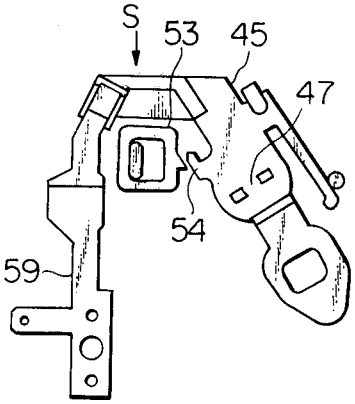
Figure 11B:
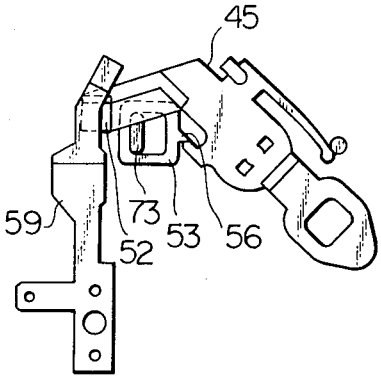
Figure 11C:
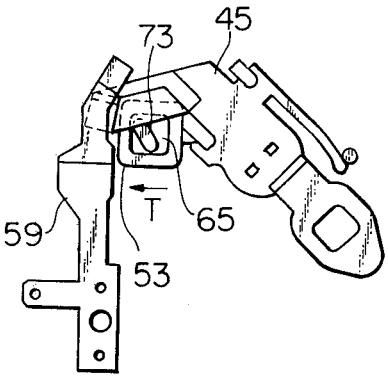
Figure 11D:
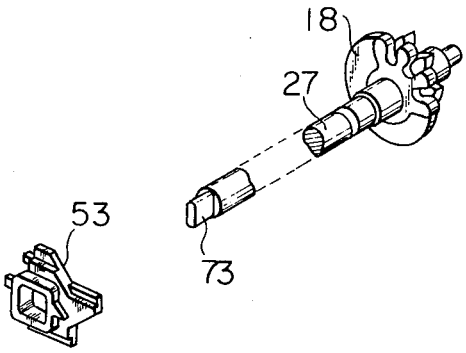
Figure 12A:
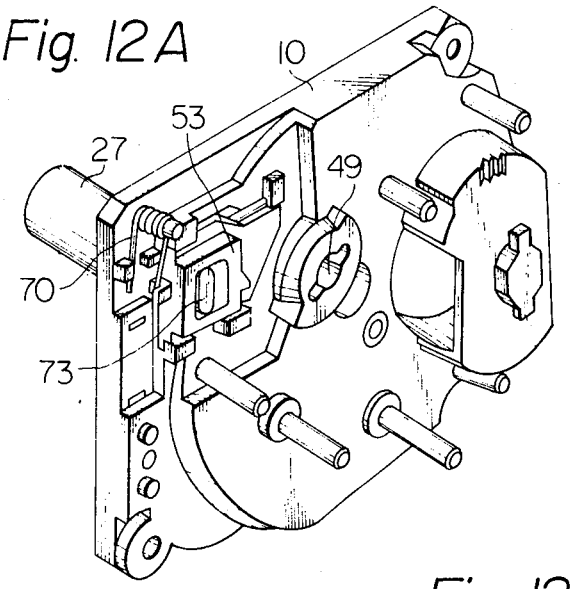
Figure 12B:
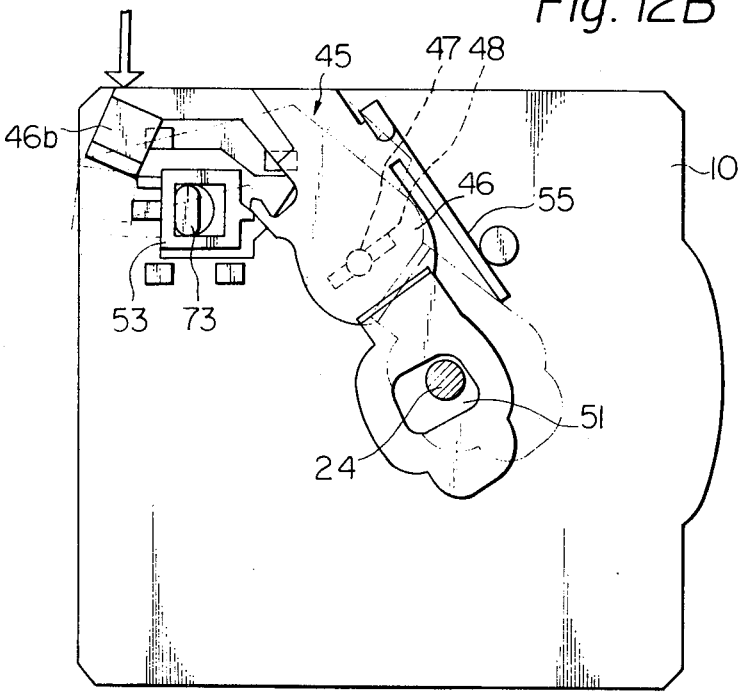

FIGS. 5A, 5B and 5C are perspective views of an hours indicating drum, minutes or hours numeral carrying card and tens of minutes indicating drum, respectively; FIGS. 6A to 6C are plan views of a supporting base plate and minutes indicating drum for explaining sequential turning operations of minutes numeral indicating cards, and FIG. 6D is a manified plan view of the base plate to explain details thereof;

FIG. 7 is a perspective view of time setting and snoozing mechanisms as disassembled;

FIG. 8A is a perspective view of an actuating lever in the time setting mechanism of FIG. 7, and FIGS. 8B and 8C are fragmentary magnified views of the actuating lever and base plate for showing their relationship;

FIGS. 9A and 9B are schematic views for explaining alarm buzzer actuating operation of switch contacts by the actuating lever;

FIG. 10A is a perspective view of a snoozing cam in the mechanism of FIG. 7, and FIG. 10B is a fragmentary view showing mounting structure of the snoozing cam to the base plate;

FIGS. 11A to 11C are schematic views for explaining sequential operations of the snoozing mechanism, and FIG. 11D is a perspective view of the snoozing cam and a shaft for driving the same; and FIG. 12A is a perspective view of the base plate with the snoozing cam and FIG. 12B is a schematic plan view of the base plate of FIG. 12A with the actuating lever mounted thereto.

Figure 1:
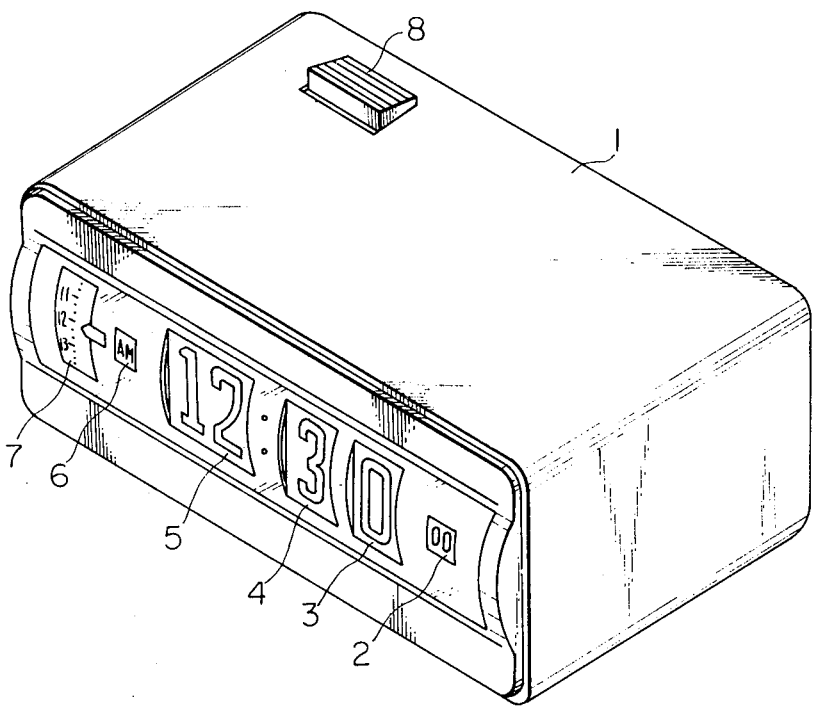
FIG. 1 is a perspective view of a digital clock of the present invention.

Referring now to the digital clock of the present invention as shown in FIG. 1, an entire clock mechanism is contained in a case 1, several windows 2 to 7 are made in the front of the case so that seconds are indicated in the window 2, minutes are indicated in the windows 3 and 4, hours are indicated in the window 5, AM and PM representations are indicated in the window 6 and a setting drum for setting an alarming time is indicated in the window 7, and a push button 8 for operating a snoozing mechanism which is capable of operating an alarming mechanism again after a fixed time is provided on the upper surface of the case 1.

Figure 2:
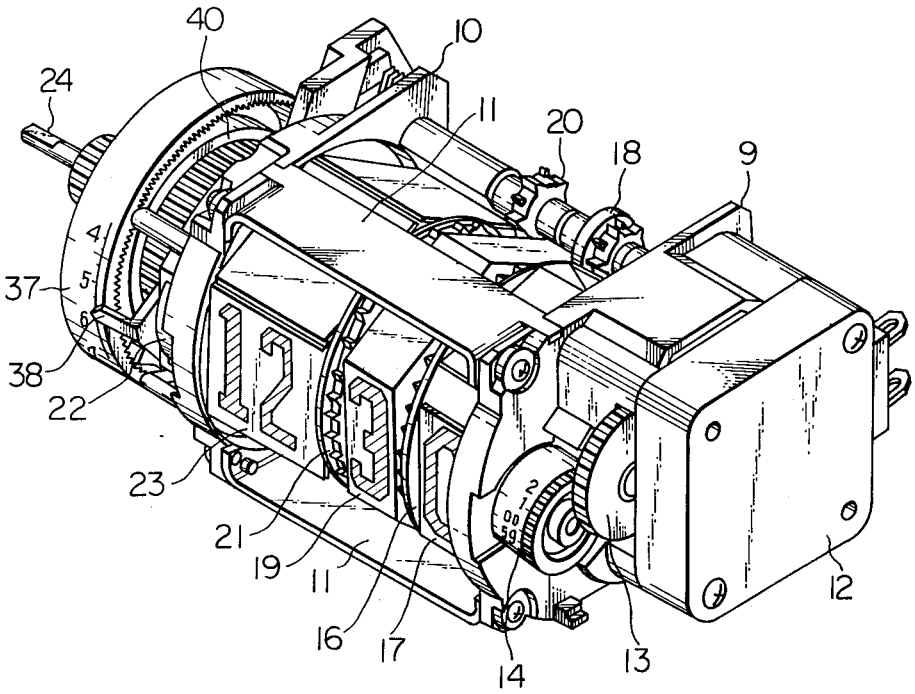
FIG. 2 is a perspective view showing interior mechanism of the clock in FIG. 1 with a case removed.

In FIG. 2 showing an interior mechanism, the time indicating mechanism is supported between two base plates 9 and 10 connected in parallel spaced relation to each other by means of connecting plates 11. In the present embodiment, a synchronous motor 12 for commercial A.C. source is fixed to the base plate 9. A seconds indicating drum 14 is rotated by the motor through a reduction gear 13 pivoted to the base plate 9 so that this drum 14 rotates at one revolution per minute. The drum 14 comes into mesh as rotated with gear teeth provided coaxially on a clutch wheel 15 coupled for speed reduction to a minutes indicating drum 16 (see FIG. 3). Minutes numeral indicating cards 17 rotatably fitted to the drum 16 along its periphery. Further, said minutes indicating drum 16 comes into mesh as rotated by the seconds drum 14 with a first pinion 18 on one side thereof through a gear part provided on a peripheral edge the drum 16. This first pinion 18 is meshing on the other side thereof with gear teeth made along a peripheral edge of a tens of minutes indicating drum 19, which has a gear part provided on the other peripheral edge that comes into mesh as the drum 19 is rotated by the first pinion 18 with one side of a second gear 20. Gear teeth on the other side of the second pinion 20 is meshing with gear teeth made along one peripheral edge on one side of an hours indicating drum 21, which has a gear part on the other side that comes into mesh as rotated for one full revolution with gear teeth provided on one side of an AM and PM indicating drum 22. Hours numeral indicating cards 23 are rotatably supported along the periphery of the hours indicating drum 21.

Figure 3:
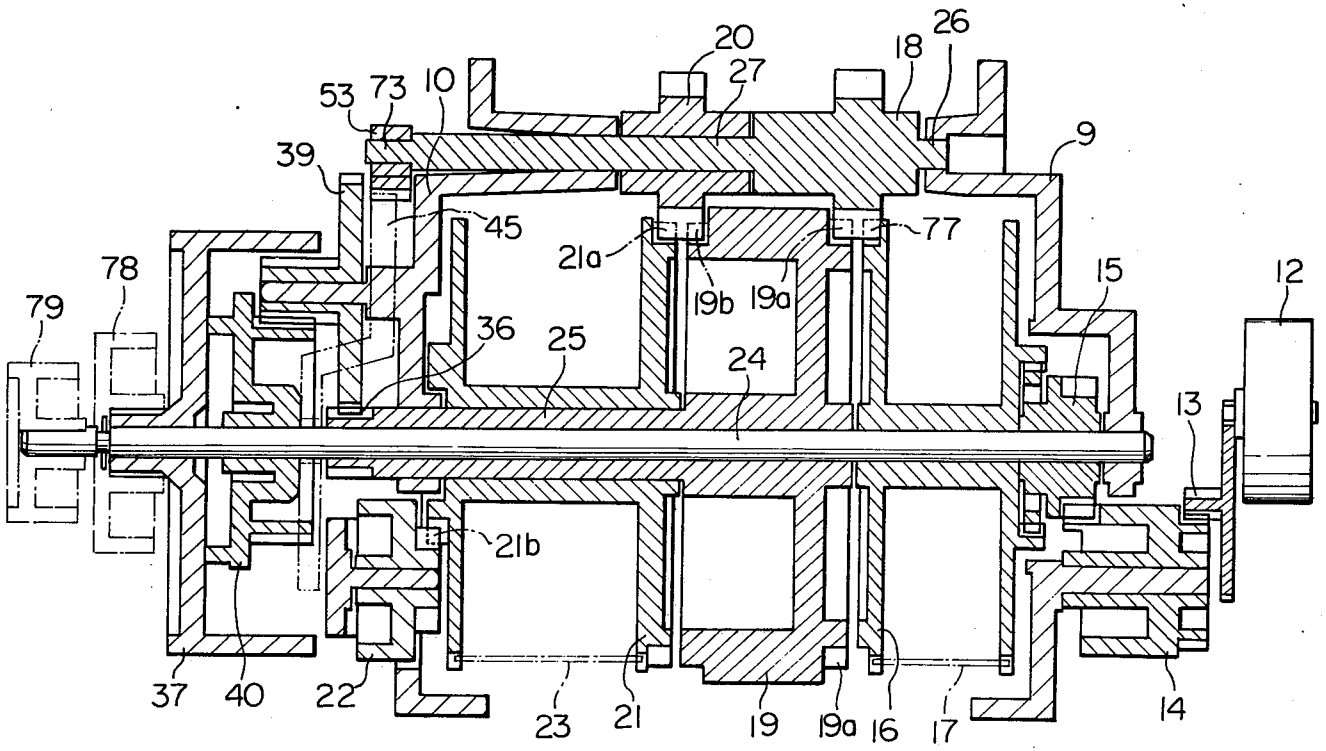
FIG. 3 is a somewhat schematic sectioned view of the mechanism of FIG. 2.

As shown in FIGS. 3 and 4, the clutch 15 is supported on a shaft 24 which is rotatably supported between the base plates 9 and 10. The minutes indicating drum 16 and tens of minutes indicating drum 19 are also rotatably supported on the shaft 24. The tens of minutes indicating drum 19 has an extended shaft 25 on one side and the hours indicating drum 21 is rotatably supported on this shaft 25. The first pinion 18 has extended shafts 26 and 27 on both sides and these shafts are pivoted respectively to the base plates 9 and 10. Further, the second pinion 20 is rotatably supported on the shaft 27 of the first pinion 18.

The structures of the respective parts shall be detailed in the following.

Figure 4A:
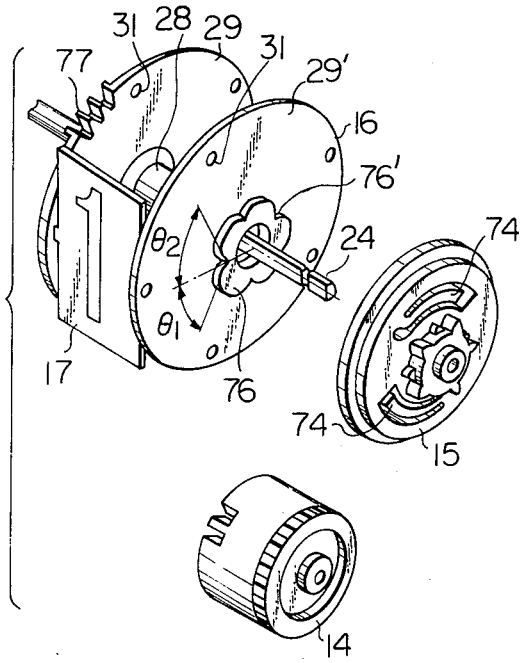
FIG. 4A is a perspective view of a minutes indicating drum and its associated seconds indicating drum and clutch as disassembled in the mechanism of FIG. 2.

As shown in FIG. 4A, 5A, the minutes indicating drum 16 is provided with flange parts 29 and 29' at both ends of a shaft 28 and the minutes numeral indicating cards 17 are pivoted between both flange parts 29, 29'.

Each card 17 is provided with projections 30 in the middles on both sides (see FIG. 5B) these said projections are rotatably inserted in respective holes 31 made in the flange parts 29 and 29' of the drum 16. The respective cards 17 are provided on the respective surfaces with numerals respectively in sets of "0" and "5", "1" and "6", "2" and "7" "3" and "8" and "4" and "9". As shown in FIGS. 6A to 6C, one flange part 29' of the drum 16 is so arranged as to rotate within a substantially circular recess 31 made in the base plate 9, a C-shaped cut 32 is made to partly communicate at 33 with the recess 31 so that edges 34 and 35 are formed in the communicating part 33 of the recess 31 and cut 32. When the drum 16 is rotated clockwise as shown in FIG. 6A, each card 17 carried by the drum 16 will engage at the front end with the edge 34. As tip end of the edge 34 or 35 is slightly extended inward the recess 31 as will be detailed later, the card 17 will be urged to turn unticlockwise when the drum and card are further rotated as shown in FIG. 6B so that the numeral carring surface of the car 17 will be reversed, for example, from "1" surface to "6" surface, as shown in FIG. 6C, and the card is carried by the drum as guided by inner periphery of the recess 31. The other edge 35 is provided in symmetrical relation to the edge 34 so that, when the drum 16 is rotated unticlockwise for time correction, the card 17 will be turned clockwise by the edge 35.

Referring further to the above arrangement more in detail with reference to FIG. 6D showing details of the inner periphery denoted by 31*a* of the recess 31 and the respective edges 34 and 35 in the base plate 9, the symmetrical edges 34 and 35 protrude inward the recess 31 by an amount $h_1$ from the substantially circular inner periphery 31*a* of the recess 31 enough for engaging inner reverse surface of the card 17 adjacent the end 17*a*. In the inner periphery 31*a*, on the other hand, there are provided radial recesses 31*b* extruding by the amount $h_2$ over the radius $R_0$ of the circular periphery 31 also in symmetrical relation with respect to the center of the circular periphery 31*a* so that, when the front end 17*a* of the card 17 is shown with a chain line in the case of normal clockwise rotation of the drum 16 and the cards 17 initially engages the protruding edge 35 to be thereby urged in inward direction to the center, the other rear end 17*b* of the card 17 slightly rotated may escape in the radial recess 31*b* out of the guiding restriction by the periphery 31*a*. The respective edge 34 and 35 have an edge surface slanted to the side of the C-shaped cut 32 so that its slanting angle $\theta$ will be larger than 45° and thus the edges will be of an acute angle in section and thereby the engagement of the edge 34 or 35 with the inner surface of the card 17 and turning guide action for the card will be smooth. Respective parts of the inner periphery 31*a* between the respective edges 34 and 35 and the respective radial recesses 31*b* are preferably made to be of a smooth surface substantially linear connecting the respective circles of the recesses 31 and 31*b*. It will be seen that the thus explained arrangement is made to be symmetrical with respect to the line X — X in the drawing passing the centers of the circular recess 31 and communicating part 33 so that the respective cards 17 will be turned similarly smoothly by the edge 34 or 35 when the drum 16 is rotated in either direction. Thus, as the radial recesses 31*b* are provided in the inner periphery 31*a* substantially acting as a guide for the rotation of the respective cards 17 in their proper position for indicating the minutes numerals at the window 3 together with the drum 16 rotated so that rearward end of each card may escape in the recess 31*b*, it is enabled that the respective edges 34 and 35 are protruded inward the recess 31 over the periphery 31*a*, whereby an engaging depth of each edge 34 or 35 in the amount $h_1$ with each card 17 can be made sufficiently large enough for ensuring that the turning operation of the respective cards is highly positively performed.

Referring back to FIG. 4A, the minutes indicating drum 16 is further provided with a gear wheel 76 having intermittent teeth 76' and preferably integrally made with the drum 16 coaxially on one side surface of the flange 29' for meshing with the clutch 15, and with gear teeth 77 at a part of peripheral edge of the other flange 29 for engaging the first pinion 18.

Referring next to FIG. 5C, the tens of minutes indicating drum 19 is provided with six flat surfaces along radial periphery and carrying numerals of "0", "1", "2", "3", "4" and "5", respectively. Further, the drum 19 is provided along one peripheral edge aside the flat surface with gear teeth 19*a* for meshing with the first pinion 18 and on the other peripheral edge partly with gear teeth 19*b* for meshing with the second pinion 20. The axially extended shaft 25 is provided in the center part of the drum 19 on the side meshing with the second pinion. Teeth 36 are made at the tip of this shaft 25.

As shown in FIG. 5A, next, the hours indicating drum 21 is of the same structure as the before described minutes indicating drum 16 of the card carrying type. In this drum 21, however, there are provided six turnable cards which representing on their respective surface numerals of "1" and "7", "2" and "8", "3" and "9", "4" and "10", "5" and "11" and "6" and "12", respectively. In the other base plate 10 which the drum 21 faces, there are provided the same recess, C-shaped cut, their communicating part and edges as in the base plate 9 for performing the same turning operation of the cards 23. The drum 21 is further provided along a peripheral edge on the side facing the lens of minutes indicating drum 19 with gear teeth 19*a* for meshing with the second pinion 20 and on the other side with teeth 21*b* for meshing with the AM and PM indicating drum (see FIG. 3).

Each of the first and second pinions 18 and 20 is provided on the peripheral surface with gear teeth consisting of two kinds different on one side and the other side. The second pinion 20 is loosely fitted to the shaft 27 of the first pinion 18 for free rotation thereabout.

When the motor 12 rotates, its rotation will be transmitted through the reduction gear 13 sequentially to the seconds indicating drum 14, to the clutch 15, minutes indicating drum 16, first pinion 18, tens of minutes indicating drum 19, second pinion 20, hours indicating drum 21 and finally to the AM and PM indicating drum 22.

The seconds indicating drum 14 is rotated at one revolution per 60 seconds. The minutes indicating drum 16 having five turnable cards respectively carrying two numerals on the both surfaces rotates intermittently at two revolutions per 10 minutes. The first pinion 18 is caused to make ½ revolution intermittently while the minutes indicating drum 16 makes one revolution. The tens of minutes indicating drum 19 is rotated for 1/6 revolution intermittently while the first pinion 18 makes one revolution. The hours indicating drum 21 having the six turnable cards carrying respectively two numerals on the both surface is caused to make 1/6 revolution while the tens of minutes indicating drum 19 makes one revolution. The AM and PM indicating drum 22 will make ¼ revolution intermittently while the hours indicating drum 21 makes one revolution. With the above described arrangement, the time is correctly digitally indicated.

The time setting mechanism and snoozing mechanism in the clock of the present invention shall be explained in the followings.

In FIG. 2 showing these mechanisms on the left side, of the clock mechanism, a disk member indicated by 37 is a time setting wheel peripherally calibrated for 24 hours, which is made so that, when said wheel is manually rotated to match its calibration of a desired predetermined time with a pointer 38, a buzzer (not illustrated) will be able to be sounded when the predetermined time is reached in the clock mechanism. Referring to FIG. 7 showing in a perspective view these mechanisms as disassembled, the gear 36 is provided at the tip of the shaft 25 of the tens of minutes indicating drum 19 loosely fitted to the shaft 24 meshes with a rotation transmitting wheel 39, which in turn meshes at its gear 39*a* with peripheral gear 41 of a set time indexing wheel 40 fitted to the shaft 24 for free rotation thereabout. The time setting wheel 37 is also fitted for free rotation to the shaft 24 so as to enclose the indexing wheel 40. This wheel 40 is provided on one lateral side surface with lateral side surface with a plurality of projections 42 respectively having a slope 42*a* and arranged concentrically project in the axial direction. The time setting wheel 37 is provided on its body 43 with a plurality of holes 44 allowing the projections 42 of the indexing wheel 40 to be respectively fitted therein. Therefore, when the projections 42 of the indexing wheel 40 rotated following the rotation of the tens of minutes indicating drum 19 are fitted respectively in the holes 44 of the time setting wheel 37, the indexing wheel 40 will axially move on the shaft 24 in the direction indicated by the arrow Y in FIG. 7. There is provided an actuating lever 45 for cooperating with this axial movement of the indexing wheel 40, the details of the structure of which lever 45 are shown in FIG. 8A.

The actuating lever 45 is provided with a pivoting shaft 47 projecting substantially in the center of the body 46 which is formed as bent to be substantially in the form of L in a plan view, and with crosswise projections 48 at the tip of said shaft 47 as seen in FIG. 8B. This shaft 47 is to be inserted in a substantially rectangular hole 48 made in the base plate 10 as shown in FIGS. 8C and 12A. When the actuating lever 45 is rotated by a small amount after the shaft 47 is inserted in the hole 49 so that the projections 48 of the shaft 47 will catch and rest on the base plate 10 and thereby the actuating lever 45 will not be removed from the base plate 10. The shaft 47 as thus mounted movably to the plate 10 is shown in FIGS. 7, 8B and 12B. Particularly as shown in FIG. 8B, the actuating lever 45 can be rocked in the directions indicated by arrows B with the lower curved part 45*a* as a fulcrum and can be also rotated about the shaft 47 as indicated by arrows A in FIG. 8C. The body 46 of the lever is provided with a spring engaging projection 50 in one end part and with a hole 51 between the projection 50 and the shaft 47 (see FIG. 8A). As shown in FIG. 7, the shaft 24 is to be loosely fitted in this hole 51. The body 46 is also provided at the other end with an operating part 52 for opening and closing contactor members of a switch to switch an alarm buzzar ON and OFF. A sloped part 46*b* is formed in a part of this operating part 52. The body 46 is further provided with an engaging part 54 to engage with a snoozing cam 53 on one side, on the left side in FIG. 7, between the shaft 47 and the operating part 52 and with an elastic arm 55 spaced substantially parallelly from the body 46 on the other side, on the right side in FIG. 7. When the actuating lever 45 is mounted to the base plate 10, it will be pressed in the direction indicated by the arrow P by a compression spring 56 engaged between the projection 50 of the lever 45 and the base plate 10. In the mounted state of the lever 45 to the base plate 10, the elastic arm 55 resiliently engages with a post 55*a* provided on the base plate 10 so as to urge the actuating lever 45 in the direction indicated by an arrow Z.

The switch for actuating the alarm buzzer (not shown) comprises a fixed contactor 57 and a movable contactor 59, as shown in FIG. 7. The fixed contactor 57 has legs 58 which are inserted in grooves (not shown) of the base plate 10 to fix the contactor thereto and the movable contactor 59 of an L-shape is fixed at its one end to the base plate 10 as opposed at its the other end to the fixed contactor 57. The reference numeral 60 represents a contact part provided on the movable contactor 59 and its tip part 61 is adapted to be engageable with the operating part 52 at the tip of the actuating lever 45, as shown in FIG. 9A. Further in FIG. 7, an engaging piece 63 having a pawl 62 is rotatably fitted to the base plate 10 and is engaged at the tip with a post 64 provided on the base plate 10 so that, when the time setting wheel 37 is mounted to the shaft 24, the pawl 62 will resiliently engage toothed inner periphery of the cylindrical body of the time setting wheel 37 so as to resiliently restrict the rotation of the time setting wheel 37.

Now, the operation of sounding the buzzer (not illustrated) at any desired time shall be explained with reference to FIG. 7. When the tesn of minutes indicating drum 19 rotates, the transmitting wheel 39 meshed with the gear 36 of the shaft 25 rotating together with the rotation of the tens of minutes indicating drum 19 will be rotated and thereby the indexing wheel 40 is also rotated. When the projections 42 of the wheel 40 drops respectively into the holes 44 in the time setting wheel 37 set at a preset time for alarming due to the rotation, the indexing wheel 40 will move in the direction indicated by the arrow Y.

Before the projections 42 of the setting wheel 40 drop respectively into the holes 44 in the time setting wheel 37, the indexing wheel 40 will press the actuating lever 45 in the direction indicated by an arrow $\theta$ against the force of the spring 56, the actuating lever 45 will rotate in the direction indicated by an arrow U with the projections 48 of the shaft 47 as a rotary axis and, therefore, as shown in FIG. 9A, the operating part 52 of the actuating lever 45 will push up the tip part 61 of the movable contactor 59, the contact part 60 of the movable contactor 59 will be separated from the fixed contactor 57, both contactors will be off each other and the buzzer will not sound.

Whe the projections 42 of the indexing wheel 40 drop respectively into the holes 44 in the time setting wheel 37, the wheel 40 will move in the direction indicated by the arrow Y on the shaft 24, whereby the actuating lever 45 will be moved at one end in the direction indicated by the arrow P by the force of the spring 56 with said movement, so that the operating part 52 will move in the direction indicated by an arrow V and, therefore, as in FIG. 9B, the operating part 52 of the lever 45 will be separated from the tip part 61 of the movable contactor 59 and the movable contactor 59 and fixed contactor 57 will contact each other to sound the buzzer.

The snoozing mechanism shall be explained in the following. As shown in FIGS. 10A and 10B, the snoozing cam 53 is provided with a substantially square through hole 65 in the interior, a projection 66 having a slope C on one side and a projection 67 on the other side, and is movably held in a recess 68 made in the base plate 10 at the upper and lower sides. A pair of projections 69 are provided for preventing the snoozing cam 53 from being removed out of the recess 68. Further, a spring 71 is wound on a shaft 70 and is engaged at one end with the projection 67 of the snoozing cam 53 and at the other end with a projection 72 provided on the base plate 10 so as to press the snoozing cam 53 in the direction indicated by an arrow W. A flattened end 73 of the shaft 27 of the first pinion 18 (see FIG. 11D) is to be inserted into the through hole 65. As shown in FIG. 3, the time setting wheel 37 is provided with a knob 78 at exterior end out of the case 1 and the shaft 24 is provided with a knob 79 at an end extending further out of the knob 78 for manual access.

The operation of the snoozing mechanism shall be explained in the following with reference to FIGS. 11A to 11C showing the relative positions of the snoozing cam 53, actuating lever 45 and movable contactor 59. In FIG. 11A showing the snoozing mechanism before being operated, but the indexing wheel 40 has dropped into the time setting wheel 37 to sound the buzzer. That is, in this state, the movable contactor 59 is in contact with the fixed contactor 57. When a force is applied in the direction indicated by an arrow S to rotate the actuating lever 45 anticlockwise in the drawing with the shaft 47 as the center, as shown in FIG. 11B, the actuating lever 45 will rotate and the projection 56 of the snoozing cam 53 will engage with the engaging part 54 of the actuating lever 45 to clamp the lever. The operating part 52 at the tip of the lever 45 will also move, so that the tip of the movable contactor 59 will be pushed up by the sloped part **45*b*, whereby the same state as shown in FIG. 9A will be established so that the movable contactor 59 and fixed contactor 57** will separate from each other to stop the sounding of the buzzer.

Now, as the tip part 73 of the first pinion 18 rotates at one revolution per 5 minutes, in the state of FIG. 11B, the snoozing cam 53 will be in the closest position to the center of the first pinion 18 so that, as shown in FIG. 11C, the flattened tip 73 of the first pinion's shaft will contact the inside of the through hole 65 to move the snoozing cam 53 in the direction indicated by an arrow T. Therefore, the projection 56 of the snoozing cam 53 and the engaging part 54 of the actuating lever 45 will be disengaged with each other, the state of FIG. 11A will be returned and the buzzer will sound. In the present embodiment, the buzzer with the snoozing mechanism operated will sound again in 5 minutes after the sounding of the buzzer is once stopped.

Figure 4B:
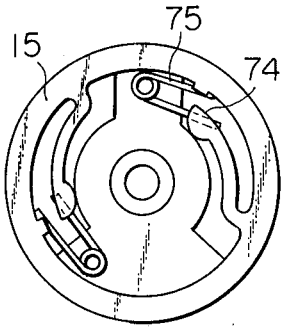
FIG. 4B is a plan view of the clutch of FIG. 4A.

Now, the time adjusting mechanism shall be explained. As the shaft 24 is substantially semi-circular in section and the center hole of the minutes indicating drum 16 is formed to be also semi-circular so as to fit the shaft 24 therein, the minutes indicating drum 16 will also rotate when the knob 79 is rotated to rotate the shaft 24, so that the indication of the minutes numeral will be able to be adjusted. Referring to FIGS. 4A and 4B, two resilient pawl 74 on one side of the clutch 15 are urged toward the center of the clutch respectively by a spring 75. These pawls engage at the tip respectively in each of recesses 76' in the gear 76 provided on the side of the minutes indicating drum 16. In these recesses 76', pressure angle $\theta_1$ against the rotation of the drum 16 in the normal direction is made smaller than the other pressure angle $\theta_2$ in the reverse direction so that the shaft 24 will be easy to rotate in the normal direction in which the minutes numerals of the cards increase in the order of 0, 1, 2, 3, . . . , but will be given a little resistance to the rotation in the reverse direction in which the minutes numerals decrease in the order of 9, 8, 7, 6, . . . .

While the present invention has been detailed only with reference to the digital clocks illustrated, it will be understood that the invention may not be limited to such digital clocks but may be also equally applied to any other types of clocks.

According to the present invention, since the actuating lever is operated by the axial movement of the set time indexing wheel to close the switch contacts when a set time is reached and the snoozing action of opening the contacts temporarily is performed by rotating only the actuating lever, the structure is simple, the number of required component parts can be greatly reduced and the cost can be reduced.

According to the present invention, when the same is applied to digital clocks, the rotation of shifting pinion for time indicating numerals is utilized as a driving means of the snoozing mechanism and, therefore, no special component acting as the driving means of the snoozing mechanism is required, the number of component parts can be greatly reduced and the cost can be reduced.

Further according to the present invention, as the switch contacts once opened by the snoozing mechanism is again closed in a predetermined time after the desired set time reached always independently of the timing of the snoozing operation, a correct time can be always confirmed by the user.

According to the present invention, as the set time indexing wheel is driven directly by the rotation of the tens of minutes indicating drum, the number of component parts can be reduced as compared with the case of driving the indexing wheel through reduction gear arrangement.

We claim:

1. An alarming device of clocks comprising a drive source; a clock mechanism supported between a pair of opposing base plates to be driven by said drive source and including a time indicating means which is intermittently shifted by means of intermittent rotary shafts rotated intermittently;

an alarm sound source;

a set time indexing wheel rotated about a shaft and shifted in an axial direction of said shaft as actuated by said clock mechanism when a set time is reached;

an actuating lever pivotable respectively in a first plane including said axial direction of the shaft of said indexing wheel and in a second plane perpendicular to said first plane and parallel to a surface of one of said base plates;

a switching means for said alarm sound source comprising a stationary contactor and a movable contactor reciprocally actuated following pivoting movement of said actuating lever in respective directions in said first and second planes; and a snoozing means for restricting said movements of the actuating lever for a fixed period, said snoozing means including a snooze cam movable along said second plane and an eccentric rotary shaft formed at an end of one of said intermittent rotary shafts of said clock mechanism, the arrangement being such that said actuating lever pivotally moves along the first plane responsive to said shift of the indexing wheel in said axial direction to switch said switching means into ON-state, the actuating lever is pivotally moved manually along the second plane so as to be restricted by said snoozing means in a position for switching the switching means into OFF-state, and said snooze cam of the snoozing means is shifted in response to said intermittent rotary motions of said eccentric rotary shaft so as to release said restriction of the actuating lever after a predetermined time has lapsed.

2. The device according to claim 1 wherein said snoozing cam is provided with a projection on one side thereof so as to engage said actuating lever and with an aperture substantially in the center, said eccentric rotary shaft being inserted in said aperture of the cam to intermittently drive the same.

3. The device according to claim 1 wherein said clock mechanism is disposed between a pair of supporting base plates, said actuating lever is provided substantially at the center thereof with a pivoting shaft for pivotably mounting the lever to one of said base plates, said pivoting shaft having at its tip end a projection for preventing the lever from being dismounted from the plate, and the actuating lever is further provided adjacent an end of the side which the lever engages the indexing wheel with an aperture for receiving a shaft of the wheel in a manner of allowing free rotation of the wheel with respect to the lever and at the other end with a slanted surface for engaging said movable contactor.

* * * * *